US005178666A

United States Patent [19]

Diaz et al.

[11] Patent Number: 5,178,666

[45] Date of Patent: Jan. 12, 1993

[54] LOW TEMPERATURE THERMAL UPGRADING OF LATERITIC ORES

[75] Inventors: Carlos M. Diaz; Ahmed Vahed; Dingzhu Shi, all of Mississauga; Christopher D. Doyle, Cambridge; Anthony E. M. Warner, Fonthill; Douglas J. MacVicar, Port Colborne, all of Canada

[73] Assignee: Inco Limited, Toronto, Canada

[21] Appl. No.: 801,945

[22] Filed: Dec. 3, 1991

[51] Int. Cl.[5] ..... C22B 23/02

[52] U.S. Cl. ..... 75/629

[58] Field of Search ..... 75/629

[56] References Cited

U.S. PATENT DOCUMENTS

| | | | |
|---|---|---|---|
| 3,272,616 | 9/1966 | Queneau | 75/629 |
| 3,914,124 | 10/1975 | O'Neill | 75/629 |
| 4,120,698 | 10/1978 | Atchison | 75/629 |

*Primary Examiner*—Peter D. Rosenberg

*Attorney, Agent, or Firm*—Edward A. Steen; Bruce S. Londa

[57] ABSTRACT

This invention relates to a thermal upgrading process whereby nickel-containing limonite or limonite/saprolite blends are pelletized with requisite amounts of solid carbon reductant and a sulfure-bearing concentrating agent. The pellets are fed to a reactor where they are gradually heated, causing reduction of the metal values. The reduced pellets are then held in a "metallics growth zone" of the reactor at a temperature high enough to allow for liquid-phase migration of the metallics within the pellets but below the point at which the pellets become sticky. The metallics growth zone is provided with a carefully controlled combustion gas atmosphere equivalent to about 60–65% aeration of partial combustion of natural gas which prevents further reduction or re-oxidation and thus provides a good environment for metallic particle growth. After a sufficient retention time, the pellets are then rapidly cooled to prevent the disproportionation of wustite to magnetite. The cooled pellets are then ground and the magnetic fraction separated.

19 Claims, No Drawings

LOW TEMPERATURE THERMAL UPGRADING OF LATERITIC ORES

BACKGROUND OF THE INVENTION

The present invention relates to the low temperature thermal upgrading of nickel-containing lateritic ores to provide concentrated metal values amenable to magnetic separation. More particularly, the invention relates to a process whereby lateritic ores undergo heat treatment to induce selective reduction to metallic values followed by concentration of the metals. Even more specifically, the invention provides a process for the thermal upgrading of nickel-containing ores with a high iron/nickel weight ratio.

Lateritic nickel ores are of two types, referred to as saprolites and limonites. Saprolites consist mainly of hydrated magnesium, iron and nickel silicates with a nickel content of about 2-2.5%; limonites consist mainly of hydrated ferric iron oxide, with a nickel content of about 1-1.5%. These ores also contain minor amounts of cobalt. In contrast with sulfidic nickel ores, which are amenable to concentration by physical techniques, lateritic ores are characterized by wide dispersion of the oxidic nickel values throughout the ore in the form of solid solution in the ore minerals. Consequently, the hydrometallurgical and pyrometallurgical processes which are currently practiced to recover nickel from lateritic deposits must handle all of the ore through the various stages of the process. It is therefore quite desirable to develop techniques which can render lateritic ores amenable to concentration prior to leaching or smelting to reduce the cost and environmental hazards associated with the handling of unwanted material. The lower the nickel content of the ore, e.g. limonites, the more desirable are these techniques.

One technique which has been proposed in the past to render a lateritic ore amenable to concentration by physical means is thermal upgrading. In this process, the ore is subjected to reduction to form ferronickel particles. (Cobalt, if present in the ore, is also reduced, and reports to the ferronickel particles. Accordingly, all references herein to metallics resulting from the reduction of lateritic ores should be understood as an iron-nickel-cobalt containing alloy.) Concentrating agents are added to the ore to enhance the growth of the ferronickel particles to a size which makes them amenable to concentration by comminution and magnetic separation.

Numerous attempts have been made to develop an effective thermal upgrading process. None of these, however, has been shown to be commercially feasible. Furthermore, most of them have preferentially addressed the treatment of the saprolitic, high grade ores. As a result, there are no thermal upgrading processes applicable to the lower grade limonite or blends of limonite and saprolite with high iron/nickel weight ratio.

U.S. Pat. No. 3,388,870 to Thumm et al discloses a process wherein the ore is pelletized with concentrating agents, including a sulfur-bearing material, and a reagent from the group consisting of alkali and alkaline earth metals. The pellets, along with a reducing agent, such as reducing gas or fuel oil, are charged into a reacting vessel preferably at 950°-1150° C. In addition, carbon reductant may be incorporated into the pellets. Temperature, retention time and atmosphere are controlled so as to reduce substantially all the nickel to metallic nickel and substantially all the iron to wustite (nominal FeO), with a limited amount to metallic iron.

U.S. Pat. No. 4,490,174 to Crama et al discloses a process whereby lateritic ore is reduced at 920°-1120° C. in a $CO/CO_2$ atmosphere in the presence of a sulfur compound concentrating agent to produce a ferronickel concentrate. Crama et al have, in a sense, improved upon Thumm et al by eliminating the need for an alkali or alkaline earth metal concentrating agent. However, Crama et al employs a gaseous reduction reaction which requires such an overwhelming amount of gas to ore ratio and has such a slow reaction time, as to make this process commercially impractical. Though Crama et al recognize the potential for the use of solid reductant, they fail to develop the specific conditions for the effective use of this type of reductants.

Other existing problems in the field of thermal upgrading technology include the control of the reduction reactions. This is of critical importance in the treatment of ores with high iron/nickel weight ratios. Since iron is present in amounts as high as 40 times that of nickel, it is desirable that substantially all the nickel be reduced to metal while only a minor proportion of the iron is reduced to metal. In addition, it is difficult to prevent the appearance of unwanted iron oxide phases. It is desirable to have as an end product metallic ferronickel and non-magnetic wustite, which will easily separate from each other. However, in the treatment of these type of ores, magnetite may be formed by disproportionation of the wustite during cooling of the thermally upgraded material, having the result that in the subsequent separation the magnetic fraction becomes diluted with this contaminant.

Most of the previously proposed thermal upgrading processes recommend temperatures which are above the so called "softening" temperature of the ores in order to achieve the desired growth of the ferronickel particles. However, above this temperature the ore becomes sticky. Consequently, the ore agglomerates, pellets or briquettes, sinter to each other and form accretions on the furnace walls. Coating of the agglomerates has been suggested as a solution to this problem. However, this adds an additional operating step. In contrast, the present invention practices a low temperature type of thermal upgrading, wherein "low temperature" is defined as the maximum temperature compatible with the avoidance of stickiness among the agglomerates.

Another variation of thermal upgrading is the process currently practiced by Nippon Yakin Kogyo Co. Ltd. at Oheyama, Japan as described by Arai et al in "An Economical Process for Stainless Steel Production from Nickel Ores", Proceedings of the International Symposium on Ferrous and Non-Ferrous Alloy Processes, Hamilton, Ontario, Canada, Aug. 26-30, 1991. This process is related to the Krupp-Rehn process for direct reduction of iron ore in rotary kilns. It involves the semi-fusion of the ore to provide the conditions to grow the ferronickel to millimeter size particles. This process is limited to a certain type of saprolitic ores with a low iron/nickel weight ratio. In addition, the semi-fused ore causes the formation of rings on the kiln walls. This results in substantial kiln downtime.

It is thus an object of the present invention to provide a process for the low temperature thermal upgrading of lateritic ore which produces a high grade nickel concentrate at high recovery for a low cost.

It is a further object of the present invention to provide a process which utilizes a minimum of reagents and has a relatively fast reaction time.

It is a still further object of the invention to provide a process which can achieve high nickel grade and high recovery by controlling the degree of iron reduction and metallic particle growth and preventing the formation of unwanted constituents.

It is an additional object of the invention to provide a process which will be effective for both limonite and blends of limonite and saprolite.

SUMMARY OF THE INVENTION

Accordingly, the present invention provides a process whereby nickel-containing limonite or limonite/saprolite blends are agglomerated, for example, pelletized, with requisite amounts of solid carbon reductant and a sulfur-bearing concentrating agent. The pellets are fed to a reactor where they are gradually heated, causing reduction of the metal values and controlled reduction of the iron oxides. The reduced pellets are then held in a "metallics growth zone" of the reactor at a temperature high enough to allow for liquid-phase migration of the metallics within the pellets but below the point at which the pellets become sticky. The metallics growth zone is provided with a carefully controlled combustion gas atmosphere which prevents further reduction or re-oxidation and thus provides a favorable environment for metallic particle growth. After a sufficient retention time, the pellets are then rapidly cooled to prevent the formation of magnetite. The cooled pellets are then ground and the magnetic fraction separated by known methods.

The solid carbon reductant, preferably bituminous coal, is added in amounts which are dictated by the iron and nickel content and their weight ratio in the ore. Additions of 4 to 6 wt. % were sufficient for the ores used in the inventors' test work. However, lower or higher additions might be required for other ores. Sulfur-bearing agents are added in at about 2 to 4 wt. % equivalent sulfur, and may be, for example, elemental sulfur, pyrite or pyrrhotite. Again, lower or higher sulfur additions might be required, depending on chemical and metallurgical composition. The pellets are fed to a reaction vessel, such as a rotary kiln, shaft furnace or the like, in countercurrent relation to the combustion gases. Reduction takes place in the pellets as the solid carbon and the volatiles therein react with oxygen found within the pellets.

While various zones of the vessel are defined and different reaction stages are noted, it should be understood that these are gradient zones and are not wholly distinct from one another. Likewise, while reduction and metallic growth take place predominantly in certain zones, both of these mechanisms occur at varying degrees throughout the reaction vessel.

As the pellets pass through the reactor, first through a preheat zone and then a reduction zone, they are gradually brought to temperatures required for reduction to occur. The pellets continue along the vessel, moving closer to the end where combustion is taking place, experiencing higher temperatures along the way towards the metallics growth zone. As the pellets approach the growth zone, further reduction occurs and metallics growth proceeds. The metallics growth zone is defined by a generally constant temperature near the burner end wherein the reduced pellets are retained to allow the reduced nickel, cobalt and iron metal to congregate into distinct ferronickel particles. It is believed that the metal values migrate within the pellets by way of a Fe—S—O liquid phase therein. Thus, it is important that the temperature be chosen so as to allow the formation of this liquid phase while preventing the pellets from becoming sticky. Temperatures in the range 950°-1150° C., preferably 1000°-1100° C., have been found to work well. Retention time in the growth zone is also an important parameter. Generally, it has been found that about one half-hour to one hour in the growth zone will allow for good concentrate grade and metal values recovery.

An important aspect of the present invention has been discovered with regard to the metallics growth zone. Because of the various oxidation states possible for iron, it is vital that these states be controlled to produce the desired product. Generally, it is believed that iron constituents undergo the following transformation along the reactor path: goethite (FeO.OH), hematite ($Fe_2O_3$), magnetite ($Fe_3O_4$), wustite (nominal FeO), metallic Fe. As stated above, in practicing the invention it is desirable to transform the bulk of the iron into non-magnetic wustite with the remainder predominantly as metal in ferronickel particles with iron/nickel ratio of about 4 to 6. Under-reduction results in low nickel recovery, while over-reduction results in low magnetic concentrate nickel grades.

Accordingly, the present inventors have discovered that by providing a favorable gaseous environment in the growth zone, neither under-reduction nor over-reduction occurs. It has been found that such an environment can be provided by maintaining the required combustion gas atmosphere for coexistence of wustite and the target Fe-Ni metallics. This gaseous environment can be defined as the equivalent of partial combustion of natural gas at about 60-65% aeration, preferably 62-63%.

In addition to the conditions described above, it has been discovered that the cooling rate has an important effect on the chemical and mineralogical composition of the thermally upgraded ores with high Fe/Ni weight ratios, such as limonite or limonite-saprolite blends. After the pellets have undergone thermal upgrading, it is necessary to cool them to room temperature for ease of handling in the subsequent grinding and separation stages. However, cooling at too slow a rate can lead to the reappearance of magnetite as a result of disproportionation of the metastable wustite phase. Cooling times of approximately 30-60 minutes are practical and are fast enough to prevent this phenomenon and thus permit the target concentrate to be obtained in subsequent magnetic separation. Longer cooling times are acceptable as long as the above-mentioned wustite disproportionation is avoided.

DESCRIPTION OF THE INVENTION

Numerous experiments were performed which illustrate the above principles and which demonstrate the efficacy of the claimed process.

EXAMPLE 1

Bench-scale experiments were performed to demonstrate the thermal upgrading process on various limonite ores. Ores at <10 mesh were pelletized with bituminous coal and elemental sulfur in amounts described. One kg of pellets was used for each run. A preheating furnace was set at 600° C. and a thermal upgrading (combined reduction and growth) furnace was set at 1000° C., both in a $N_2$ gas inert atmosphere. Furnaces were 9" diameter. The pellets were kept at 600° C. for 60 minutes, at 1000° C. for 60 minutes, and cooled in about 40 minutes with $N_2$ gas in the water cooled end of the furnace. A 50 g sample of thermally upgraded pellets was ground for four minutes in a Bleuler mill and magnetically separated using a Davis tube at 1000–4800 Gauss.

Various ores tested assayed as follows, in weight %:

Limonite A: 1.34 Ni, 0.19 Co, 46.7 Fe, 4.51 $SiO_2$, 1.46 MgO, 1.23 Mn, 2.46 Al.

Limonite B: 1.14 Ni, 0.08 Co, 42.6 Fe, 5.92 $SiO_2$, 1.31 MgO, 0.47 Mn, 3.89 Al.

Limonite C: 1.37 Ni, 0.15 Co, 43.8 Fe, 8.6 $SiO_2$, 2.6 MgO, 0.92 Mn, 3.7 Al.

Saprolite: 1.7 Ni, 0.06 Co, 22 Fe, 26.7 $SiO_2$, 15.1 MgO, 0.44 Mn, 2.44 Al.

Kiln Dust Saprolite: 2.6 Ni, 0.1 Co, 24 Fe, 35.3 $SiO_2$, 16 MgO, 0.56 Mn, 1.81 Al, 1.36 C, 7.3 $Fe^{+2}$.

The bituminous coal contained: 73 total C, 51.6 fixed C, 2.3 S, 36.6 volatiles, 1.2 moisture and 7.9 ash.

All sulfur and coal values and nickel grades and recovery values are given in weight percent.

TABLE 1

| | | | Thermal Upgrading of Limonite | | | | |
|---|---|---|---|---|---|---|---|
| | | | | Magnetic Fractions | | | |
| Ore Type | Test No. | % S Added | % Bit. Coal Added | Wt. % | Ni Grade, % | Ni Rec'y, % | Metallics Fe/Ni wt. Ratio |
| A | MTU 32 | 4 | 6 | 13.1 | 9.8 | 88 | 5.2 |
| A | MTU 33 | 4 | 6 | 12.2 | 11.4 | 92 | 4.8 |
| A | MTU 42 | 4 | 6 | 11.2 | 11.0 | 87 | 4.4 |
| A | MTU 50 | 4 | 6 | 12.7 | 11.3 | 95 | — |
| A | MTU 111 | 2 | 6 | 15.6 | 9.06 | 91 | 4.6 |
| A | MTU 124 | 2 | 6 | 14.3 | 10.1 | 94 | 4.6 |
| A | MTU 35 | 2 | 5 | 14.4 | 10.7 | 87 | 3.2 |
| A | MTU 68 | 2 | 5 | 14.0 | 10.6 | 88 | 3.0 |
| B | MTU 73* | 4 | 4 | 14.0 | 9.25 | 88 | 3.8 |

*Test No. MTU 73 was held at 1000° C. for 80 min.

EXAMPLE 2

Tests were run for limonite A/saprolite blends. The procedure was the same as Example 1 above except samples were formed in 1½ in. diameter, ¼ in. thick rondelles. Total sample size was about 60 g. A single 5 in. diameter furnace was used with a 40 minute retention time at 600° C. and 40 minutes at 1000° C. (with some at 1100° C.) at 1% $H_2$ in $N_2$ atmosphere.

TABLE 2

| | | Thermal Upgrading of Limonite A/Saprolite | | | | | | |
|---|---|---|---|---|---|---|---|---|
| | | | | | Magnetic Recovery | | | |
| Test No. | Limonite A/ Saprolite wt. ratio | Thermal Upgrading Temp., °C. | % S Added | % Bit. Coal Added | Wt. % | Ni Grade, % | Ni Rec'y, % | Metallics Fe/Ni wt. Ratio |
| TLR 425 | 70:30 | 1000 | 2 | 6 | 12.1 | 12.0 | 80 | 3.3 |
| TLR 379 | 70:30 | 1000 | 4 | 6 | 12.7 | 11.8 | 83 | 4.9 |
| TLR 430 | 85:15 | 1000 | 2 | 6 | 12.3 | 11.3 | 80 | 3.2 |
| TLR 423 | 85:15 | 1000 | 4 | 6 | 14.2 | 10.6 | 89 | 4.5 |
| TLR 428 | 70:30 | 1100 | 2 | 6 | 13.8 | 11.1 | 86 | 4.6 |
| TLR 394 | 70:30 | 1100 | 4 | 6 | 13.0 | 12.3 | 86 | 4.7 |
| TLR 432 | 85:15 | 1100 | 2 | 6 | 14.7 | 11.1 | 94 | 5.1 |
| TLR 408 | 85:15 | 1100 | 4 | 6 | 12.2 | 12.4 | 87 | 3.9 |

EXAMPLE 3

Also tested were blends of limonite A with recycling kiln dust from a separate saprolite processing facility. Conditions were the same as those of Example 1.

TABLE 3

| | | Thermal Upgrading of Limonite A/Kiln Dust Saprolite | | | | | | |
|---|---|---|---|---|---|---|---|---|
| | | | | | Magnetic Fraction | | | |
| Test No. | Limonite A/ Kiln Dust Saprolite wt. Ratio | Thermal Upgrading Temp., °C. | % S Added | % Bit. Coal Added | Wt. % | Ni Grade, % | Ni Rec'y, % | Metallics Fe/Ni wt. Ratio |
| TULD 14 | 100:30 | 1000 | 4 | 6 | 14.8 | 12.7 | 92 | 4.7 |
| TULD 3 | 100:30 | 1100 | 4 | 6 | 16.1 | 11.7 | 92 | 5.8 |
| TULD 11 | 100:30 | 1100 | 4 | 5 | 10.9 | 16.7 | 89 | 3.5 |
| TULD 12 | 100:30 | 1100 | 4 | 4 | 8.2 | 20.2 | 82 | 2.0 |

EXAMPLE 4

The effect of cooling rate was demonstrated by producing rondelles as described above, containing limonite A, 2% S and 6% bituminous coal. After preheating for 40 minutes at 600° C., the rondelles were upgraded at 1100° C. for 40 minutes in a 1% $H_2$ in $N_2$ gas atmosphere. The rondelles were then cooled to 100° C. at various rates in a 1% $H_2$ in $N_2$ atmosphere. The quenched samples were surrounded by a water-cooled jacket for 30–40 minutes until temperature was reached. All samples were then ground and separated as in Experiment 1.

TABLE 4

| Effect of Cooling Rate | | | | | |
|---|---|---|---|---|---|
| | | Magnetic Fractions | | | |
| Test No. | Cooling Time | Wt. % | Ni Grade, % | Ni Rec'y, % | $Fe^{-3}$ % |
| TLR 137 | Slow Cool (18 hrs.) | 44.1 | 4.24 | 94.1 | 13.5 |
| TLR 104 | Slow Cool (12 hrs) | 29.6 | 5.9 | 90.5 | 12.3 |
| TLR 102 | 30 min. | 12.7 | 12 | 90.7 | n/a |
| TLR 135 | 30 min. | 13.6 | 10.9 | 89.6 | 3.7 |

As can be seen from the above data, it is clear that slow cooling allows the growth of $Fe^{3+}$, mainly in the form of magnetite. This increased magnetite percentage shows up in the increased magnetic fraction, consequently diluting the nickel grade in the magnetic fraction.

EXAMPLE 5

To ascertain the precise aeration requirements for the metallics growth zone of the reactor, limonite A samples were prepared without solid reductant so that the reducing effect due solely to the composition of the atmosphere could be isolated. Rondelles containing 4% S were upgraded in a reducing gas atmosphere generated by $CO_2/H_2$. To achieve sufficient reduction, a high volume gas to mass sample ratio of 50 $cm^3/g$ was used. $CO_2/H_2$ ratio has been converted to the equivalent aeration percent of the partial combustion of natural gas.

TABLE 5

| Effect of Atmosphere in Metallics Growth | | | | | |
|---|---|---|---|---|---|
| | | Magnetic Fraction | | | |
| Test No. | Aeration % | Wt. % | Ni Grade, % | Ni Rec'y, % | Metallics Fe/Ni wt. ratio |
| TUL 84 | 55 | 48 | 4 | 98 | 18 |
| TUL 85 | 57.5 | 37 | 5 | 98 | 12 |
| TUL 86 | 60 | 27 | 6 | 97 | 10 |
| TUL 87 | 62.5 | 12 | 11 | 78 | 3.4 |
| TUL 88 | 65 | 6 | 15 | 50 | 1.8 |
| TUL 89 | 67.5 | 4 | 11 | 29 | 1.9 |

The above data indicate that at about 62–63% aeration. wustite coexists with metallics in the target composition range. The above results are also borne out by nickel-iron phase stability data calculated by the inventors which indicate that wustite and target range metallics coexist within a band of aeration percentage values, namely about 60–65%.

EXAMPLE 6

Once having discovered the necessary parameters required to practice the novel thermal upgrading process, the inventors applied the knowledge to a pilot plant demonstration similar to a commercial operation.

A rotary kiln was chosen as the reactor vessel. The kiln measures 40 feet in length with an inside diameter of 5 feet. A burner for partial combustion of natural gas is located at the discharge end of the kiln. 500 kg/hr of pelletized feed consisting of either limonite B with 4% S and 4% bituminous coal or limonite C with 2% S and 6% bituminous coal were charged to the kiln at the feed end. A dam was provided close to the discharge end of the kiln to approximately delineate the metallics growth zone. Air pipes allow for the introduction of air into the kiln to control temperature and atmosphere. The aeration for the metallics growth zone was set at 62–63%.

The temperature profile along the length of the kiln allows for drying, heating and reduction to occur. Reduction takes place predominantly within the pellets, generated by the solid reductant therein. The temperature of the metallics growth zone was maintained at 1010° C., while the pellets themselves were at temperature for about 30 minutes of the 1 hour residence time in this zone. When the upgraded pellets reached the discharge end of the kiln, they passed by gravity to a water-cooled screw conveyor, where they were cooled to 100° C. in about 30 minutes in a $N_2$ atmosphere. The cooled pellets were then ground for 4 minutes and magnetically separated using a Davis tube at 4800 Gauss. The results are given below.

TABLE 6

| Pilot Plant Thermal Upgrading of Limonite | | | | | |
|---|---|---|---|---|---|
| | | Magnetic Fraction | | | |
| Test No. | Limonite Type | Wt. % | Ni Grade, % | Ni Rec'y, % | Metallics Fe/Ni wt. Ratio |
| 69 | B | 13.3 | 9.2 | 82 | 3.7 |
| 73 | B | 12.8 | 9.5 | 82 | 3.7 |
| 77 | C | 18.7 | 9.0 | 94 | 5.4 |
| 78 | C | 18.6 | 8.6 | 93 | 5.6 |
| 79 | C | 17.1 | 9.2 | 92 | 5.0 |

Thus, the present inventors have demonstrated a vastly improved thermal upgrading process for nickel-containing and nickel-cobalt-containing limonite and limonite/saprolite blends. By agglomerating the ore with a solid reductant and a sulfur-bearing concentrating agent, carefully controlling the atmosphere in the metallics growth zone to 60–65%, preferably 62–63% aeration, and cooling rapidly, a high quality ferronickel concentrate can be obtained. When practicing the process as described, pellets move through the reaction vessel without stickiness.

Most of the cobalt in the ore reports to the ferronickel particles. Cobalt recovery in the magnetic fraction in all of the above examples was only slightly lower than the nickel recovery.

Although the present invention has been described in conjunction with the preferred embodiments, it is to be understood that modifications and variations may be resorted to without departing from the spirit and scope of the invention, as those skilled in the art will readily understand. Such modifications and variations are considered to be within the purview and scope of the invention and appended claims.

The embodiments of the invention in which an exclusive property or privilege is claimed are defined as follows:

1. A process for concentrating nickel values contained in lateritic ores, comprising:

(a) forming agglomerates incorporating the ore, a solid reductant and a sulfur-bearing agent;

(b) feeding the agglomerates to a reaction vessel having a feed end and a discharge end, the discharge end having a burner for the partial combustion of a fossil fuel to thereby produce combustion gases, such that the agglomerates and the combustion gases flow counter-currently within the vessel to gradually heat the agglomerates to a final temperature as they pass through the vessel from the feed end towards the discharge end, whereby the iron and nickel values in the ore are selectively reduced;

(c) retaining the agglomerates in a metallics growth zone, the metallics growth zone being located adjacent the discharge end of the vessel and characterized by a generally constant final temperature and an atmosphere equivalent to the partial combustion of natural gas at between about 60-65% aeration, to prevent re-oxidation or further reduction, and to allow for the formation of distinct ferronickel particles;

(d) cooling the agglomerates in an inert atmosphere at a rate sufficient to substantially prevent the disproportionation of wustite to magnetite;

(e) grinding the agglomerates; and (f) magnetically separating the magnetic fraction of the ground agglomerates.

2. The process of claim 1, wherein the lateritic ore is limonite or a limonite/saprolite blend.

3. The process of claim 2, wherein the aeration percentage is about 62-63%.

4. The process of claim 3, wherein the solid reductant is bituminous coal.

5. The process of claim 4, wherein bituminous coal is present at between 4-6 wt. %.

6. The process of claim 3, wherein the sulfur-bearing agent is present in amounts between 2-5 wt. % sulfur.

7. The process of claim 3, wherein the total residence time of the pellets within the furnace is about 3 hours.

8. The process of claim 3, wherein the pellets are heated to a final temperature of between 950°-1150° C. and held at such temperature for at least 40 minutes.

9. The process of claim 8, wherein the pellets are held at about 1000°-1100° C. for about 60 minutes.

10. The process of claim 3, wherein the pellets are cooled to 100° C. in less than 60 minutes.

11. The process of claim 10, wherein the pellets are cooled in less than 30 minutes.

12. The process of claim 8, wherein the agglomerates are cooled to 100° C. in less than 60 minutes.

13. The process of claim 9, wherein the agglomerates are cooled to 100° C. in less than 60 minutes.

14. The process of claim 8, wherein the solid reductant is bituminous coal present at about 4-6 wt. % and the sulfur-bearing agent is present at about 2-5 wt. % sulfur.

15. The process of claim 9, wherein the solid reductant is bituminous coal present at about 4-6 wt. % and the sulfur-bearing agent is present at about 2-5 wt. % sulfur.

16. The process of claim 10, wherein the solid reductant is bituminous coal present at about 4-6 wt. % and the sulfur-bearing agent is present at about 2-5 wt. % sulfur.

17. The process of claim 11, wherein the solid reductant is bituminous coal present at about 4-6 wt. % and the sulfur-bearing agent is present at about 2-5 wt. % sulfur.

18. The process of claim 2, wherein the ferronickel particles formed have an iron/nickel weight ratio of from 3 to 6.

19. The process of claim 2, wherein the reduction reaction takes place substantially within the agglomerates.

* * * * *